US012630266B1

(12) United States Patent
Stevens

(10) Patent No.: US 12,630,266 B1
(45) Date of Patent: May 19, 2026

(54) HINGED FLOATATION MAT

(71) Applicant: Zachary Jon Stevens, Grove, OK (US)

(72) Inventor: Zachary Jon Stevens, Grove, OK (US)

( * ) Notice: Subject to any disclaimer, the term of this patent is extended or adjusted under 35 U.S.C. 154(b) by 386 days.

(21) Appl. No.: 18/220,377

(22) Filed: Jul. 11, 2023

Related U.S. Application Data

(60) Provisional application No. 63/397,186, filed on Aug. 11, 2022.

(51) Int. Cl.
*B63B 34/50* (2020.01)
*B63B 5/00* (2006.01)

(52) U.S. Cl.
CPC ..... *B63B 34/50* (2020.02); *B63B 5/00* (2013.01)

(58) Field of Classification Search
CPC ..... B63B 34/50; B63B 5/00; A47C 15/006; A47C 1/143
See application file for complete search history.

(56) References Cited

U.S. PATENT DOCUMENTS

| | | | | |
|---|---|---|---|---|
| 5,324,221 | A | 6/1994 | Kaufman et al. | |
| 7,207,857 | B2 | 4/2007 | Zheng | |
| 11,065,179 | B2 | 7/2021 | Baker | |
| 2006/0116039 | A1 * | 6/2006 | Pole, III | B63B 35/34 441/129 |

FOREIGN PATENT DOCUMENTS

| | | |
|---|---|---|
| CN | 204056266 | 12/2014 |
| CN | 210191775 | 3/2020 |
| DE | 1748124 | 7/1957 |
| FR | 340831 | 7/1904 |
| FR | 2762792 | 11/1998 |
| WO | 2007/019635 | 2/2007 |
| WO | 2013/160631 | 10/2013 |
| WO | 2020/233782 | 11/2020 |

* cited by examiner

*Primary Examiner* — Andrew Polay
(74) *Attorney, Agent, or Firm* — Dennis D. Brown; Brown Patent Law, P.L.L.C.

(57) ABSTRACT

A floatation mat with a plurality of hinged flat foam panels which can be quickly and conveniently folded for compact storage and transport, and then easily unfolded and deployed for use.

14 Claims, 4 Drawing Sheets

HINGED FLOATATION MAT

RELATED CASE

This application claims the benefit of U.S. Provisional Patent Application No. 63/397,186 filed Aug. 11, 2022 and incorporates said provisional application herein by reference in its entirety as if fully set forth at this point.

FIELD OF THE INVENTION

The present invention relates to recreational water floatation mats.

BACKGROUND OF THE INVENTION

Large floatation mats capable of use by one person or multiple people are used on lakes and streams, as well as in swimming pools and even on the ocean. A typical floatation mat will comprise a large rectangular sheet formed of one or more layers of foam. Such floatation mats are rolled up for storage when not in use.

Unfortunately, large foam floatation mats are difficult to roll compactly and, in any case, take up a great deal of space during storage or transport. Also, when unrolled, it takes time for the foam mat to relax and flatten out and, in many cases, the ends of the mat will remain curled even after resting. Moreover, the more pliable that the large foam mat is for tighter rolling, the greater tendency that the mat will have for sagging under the weight of the user(s) rather than remaining substantially flat. Such sagging not only detracts from the usefulness and enjoyment of the mat but can result in the loss of articles placed on the mat and can also pose a hazard for children and others who may become caught in or may fall off of a sagging mat, or may fall onto other users.

As an alternative to foam floatation mats, inflatable floatation mats are also available. However, although the inflatable mats require less space for storage and transport when deflated, and can be formed to remain substantially flat during use, the inflation and deflation of a large inflatable mat is difficult, time consuming, and inconvenient.

In addition, the sizes and configurations of the foam and inflatable floatation mats heretofore available in the art have generally been fixed so that, e.g., the size and configuration of a foam or inflatable mat could not be changed for use by more or fewer users, or to better facilitate different recreational activities.

Consequently, a need exists for an improved foam flotation mat which (a) can be conveniently and more compactly stored and transported without rolling, (b) will remain substantially flat and will be more resistant to sagging under the weight of the user(s), and (c) can be selectively deployed in different sizes and/or configurations for use by more or fewer users or for different recreational purposes.

SUMMARY OF THE INVENTION

The present invention provides a hinged foam floatation mat which resolves the problems and satisfies the needs mentioned above. The inventive hinged floatation mat can be quickly and conveniently folded for compact storage and transport, and then easily unfolded and deployed for use. The inventive hinged mat can also be deployed in different sizes and/or configurations and can be constructed to remain substantially flat under the weight of the user(s).

In one aspect, there is provided a hinged floatation mat which preferably comprises: (a) a first flat foam panel having a length and a width; (b) a second flat foam panel have a length which does not differ by more than 2 inches from the length of the first flat foam panel and a width which does not differ by more than 2 inches from the width of the first flat foam panel; and (c) a hinge connector extending through the first flat foam panel and the second flat foam panel. The second flat foam panel is pivotable about the hinge connector with respect to the first flat foam panel from (i) a storage position of the second flat foam panel in which a bottom surface of the second flat foam panel lies over a top surface of the first flat foam panel to (ii) one or more deployed positions of the second flat foam panel different from the storage position of the second flat foam panel.

In another aspect, there is provided a floatation mat which preferably comprises a plurality of flat foam panels, each having a longitudinal length which is substantially the same for all of the flat foam panels and a lateral width which is substantially the same for all of the flat foam panels. The plurality of flat foam panels includes at least a second foam panel and a first foam panel. The second foam panel is pivotably attached to the first foam panel such that the second foam panel can be pivoted with respect to the first foam panel to a storage position of the second foam panel in which a bottom surface of the second foam panel lies squarely over a top surface of the first foam panel with a laterally extending forward edge, a laterally extending rearward edge, a longitudinally extending right side edge, and a longitudinally extending left side edge of the second foam panel being respectively positioned over a laterally extending forward edge, a laterally extending rearward edge, a longitudinally extending right side edge, and a longitudinally extending left side edge of the first foam panel. The second foam panel is also pivotable with respect to the first foam panel to one or more deployed positions wherein in one deployed position, the second foam panel is substantially 180° from the storage position of the second foam panel.

In another aspect, the floatation mat can further comprise: (a) a hole extending through the second foam panel which is in alignment with a hole extending through the first foam panel when the second foam panel is in the deployed position of the second foam panel which is substantially 180° from the storage position of the second foam panel and (b) a locking connector which is removably extendable through the holes extending through the second and first foam panels to lock the second foam panel in the deployed position of the second foam panel which is substantially 180° from the storage position of the second foam panel.

In another aspect, the plurality of flat foam panels of the floatation mat can also include a third flat foam panel which is pivotably attached to the second foam panel such that, when the second foam panel is in the storage position of the second foam panel, the third foam panel can be pivoted with respect to the second foam panel to a storage position of the third foam panel in which a bottom surface of the third foam panel lies squarely over the top surface of the second foam panel with a laterally extending forward edge, a laterally extending rearward edge, a longitudinally extending right side edge, and a longitudinally extending left side edge of the third foam panel being respectively positioned over the laterally extending forward edge, the laterally extending rearward edge, the longitudinally extending right side edge, and the longitudinally extending left side edge of the second foam panel. The third foam panel will preferably also be pivotable with respect to the second foam panel to one or more deployed positions wherein in one deployed position, the third foam panel is substantially 180° from the storage position of the third foam panel.

Further objects, features, and advantages of the present invention will be apparent to those in the art upon examining the accompanying drawings and upon reading the following Detailed Description of the Preferred Embodiments.

DETAILED DESCRIPTION OF THE PREFERRED EMBODIMENTS

Figure 1:
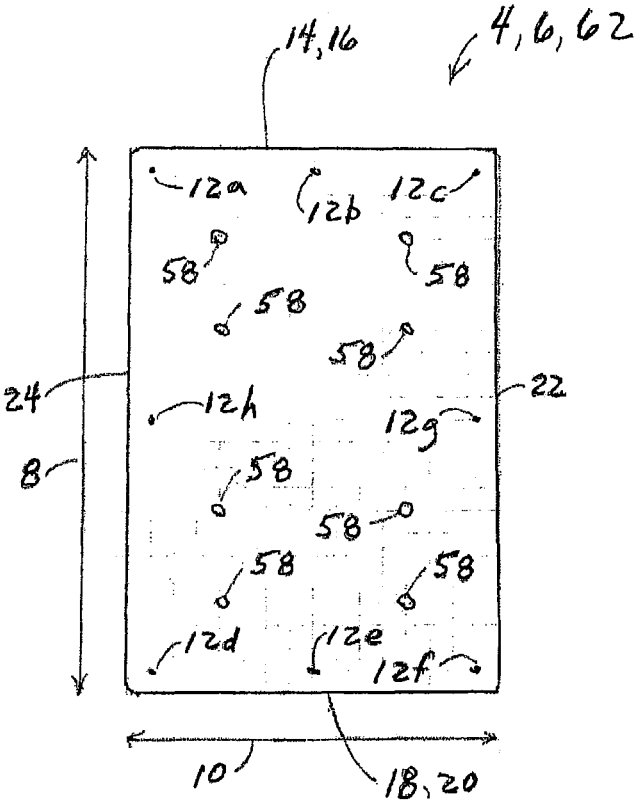
FIG. 1 is a top view which is common to each of a first flat foam panel 4 and a second flat foam panel 6 used in embodiments 2 and 60 of the hinged floatation mat of the present invention and is also common to a third flat foam panel 62 which is used in the inventive hinged floatation mat 60.
Figure 2:
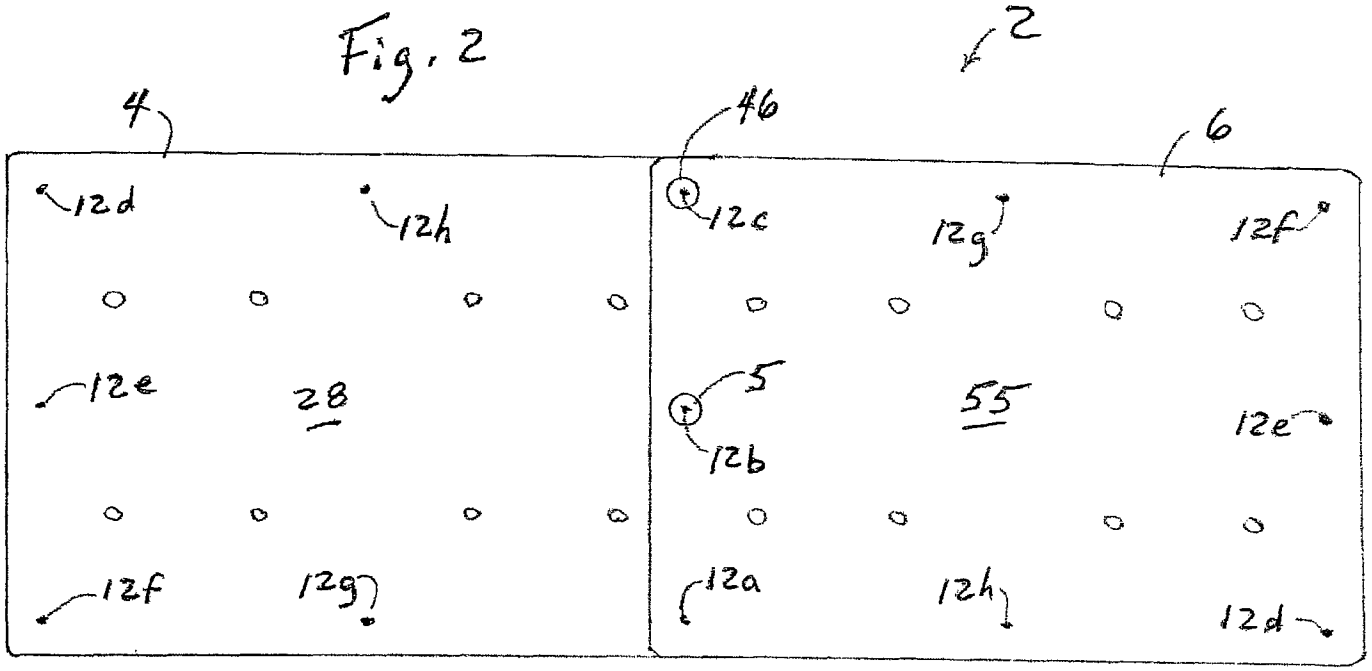
FIG. 2 is a top view of the inventive hinged floatation mat 2 in a deployed position.
Figure 3:
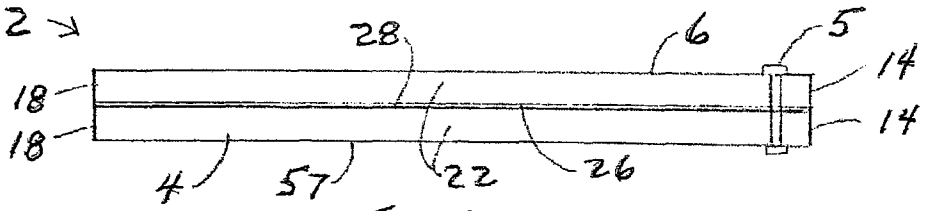
FIG. 3 is an elevational side view of the inventive hinged floatation mat 2 in a folded storage and transport position.
Figures 4, 5, 6, 7, 8:
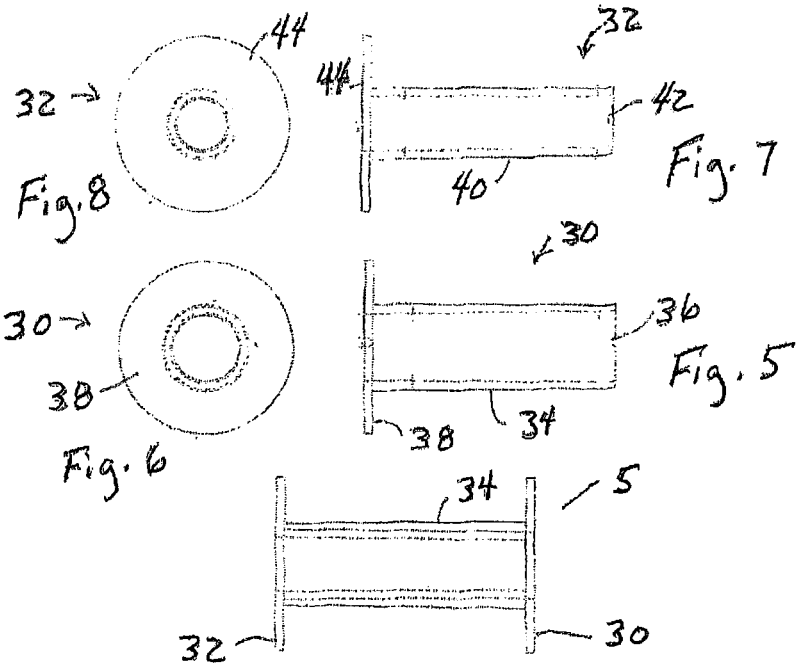
FIG. 4 is a side view of a hinge coupling 5 used in the inventive hinged floatation mat 2.
FIG. 5 is a side view of a first piece 30 of the hinge coupling 5.
FIG. 6 is an end view of the first piece 30 of the hinge coupling 5.
FIG. 7 is a side view of a second piece 32 of the hinge coupling 5.
FIG. 8 is an end view of the second piece 32 of the hinge coupling 5.

An embodiment 2 of the inventive hinged floatation mat is illustrated in FIGS. 1-3. The hinged floatation mat 2 preferably comprises a second flat foam panel 6 which is pivotably attached to a first flat foam panel 4 by a hinge coupling 5 which extends through the second and first flat foam panels 6 and 4.

The first and second flat foam panels 4 and 6 can be rectangular or any other desired shape and can be formed of substantially any buoyant foam material used for forming recreational floatation devices. The flat foam panels 4 and 6 will preferably be formed of a closed cell foam material. The panels 4 and 6 can be somewhat pliable but will preferably be rigid, or at least sufficiently rigid that the center point of each panel 4 and 6 will not deflect or bend more than six inches downward under the weight of an average sized male adult user when in the water.

The flat foam panels 4 and 6, as well as any additional flat foam panels included in the inventive hinged floatation mat, will preferably be rectangular in shape and will preferably be substantially identical in size, length 8, and width 10 (i.e., the length 8 of panel 4 will preferably the same as or will not differ by more than 2 inches from the length 8 of panel 6 and the width 10 of panel 4 will preferably the same as or will not differ by more than 2 inches from the width 10 of panel 6). The length 8 of each flat foam panel 4 and 6 will preferably be in the range of from 35 to 84 inches, or 36 to 72 inches, or 60 to 84 inches, or 65 to 75 inches, or about 70 inches (i.e., 70±2 inches). The width 10 of each flat foam panel 4 and 6 will preferably be in the range of from 6 to 54 inches and will more preferably be in the range of from 12 to 54 inches or from 20 to 50 inches.

Each of the flat foam panels 4 and 6, as well as any additional flat foam panel included in the inventive hinged floatation mat, preferably also comprises: (a) one or more, preferably at least two, spaced apart holes 12*a*, 12*b*, and/or 12*c* which extend through the flat panel adjacent to the lateral edge 14 at a forward longitudinal end 16 of the flat panel, with one of the holes 12*b* preferably being centered on the forward lateral edge 14 of the panel; (b) one or more, preferably at least two, spaced apart holes 12*d*, 12*e*, and/or 12*f* which extend through the flat panel adjacent to the lateral edge 18 at the rearward longitudinal end 20 of the flat panel, with one of the holes 12*e* preferably being centered on the rearward lateral edge 18 of the panel; (c) one or more, preferably at least two, spaced apart holes 12*c*, 12*g*, and/or 12*f* which extend through the flat panel adjacent to the longitudinally extending right side edge 22 of the flat panel, with one of the holes 12*g* preferably being centered on the right side edge 22 of the panel; and/or (d) one or more, preferably at least two, spaced apart holes 12*a*, 12*h*, and/or 12*d* which extend through the flat panel adjacent to the longitudinally extending left side edge 24 of the flat panel, with one of the holes 12*h* preferably being centered on the left side edge 24 of the panel.

Each of the holes 12*a*-12*h* is preferably located from 2 to 4 inches, more preferably about 3 inches (i.e., 3±0.5 inches), from the edge or edges 14, 18, 22, and/or 24 to which the hole is adjacent. Each hole 12*a*-12*h* is also preferably about 1 inch (i.e., 1±0.25 inch) in diameter.

The second flat foam panel 6 of the inventive hinged floatation mat 2 is pivotable with respect to the first foam panel 4 to a storage and transport position in which the bottom surface 26 of the second panel 6 lies squarely over the top surface 28 of the first panel 4 so that the laterally extending forward edge 14, the laterally extending rearward edge 18, the longitudinally extending right side edge 22, and the longitudinally extending left side edge 24 of the second foam panel 6 are respectively positioned over the corresponding laterally extending forward edge 14, laterally extending rearward edge 18, longitudinally extending right side edge 22, and longitudinally extending left side edge 24 of the first foam panel 4.

Moreover, when the second foam panel 6 is in its storage and transport position over the first foam panel 4, each of the perimeter holes 12*a*-12*h* of the second foam panel 6 is preferably positioned over and in alignment with the correspondingly positioned and numbered perimeter hole 12*a*, 12*b*, 12*c*, 12*d*, 12*e*, 12*f*, 12*g*, or 12*h* of the first foam panel 4. This allows the hinge coupling 5 of the hinged floatation mat 2 to be inserted through different pairs of the correspondingly positioned and aligned holes, e.g., 12*b*-12*b*, 12*g*-12*g*, etc. of the first and second panels 4 and 6 so that, in each case, the second panel 6 can be pivoted about the hinge coupling 5 over a range of 360° with respect to the first panel 4 to provide one or more alternative deployed configurations but can still be returned or pivoted back to the compact storage and transport position of the second panel 6 squarely over the first panel 4.

In other words, changing the pair of correspondingly positioned and numbered holes through which the hinge coupling 5 is inserted will not change the shape of the inventive hinged floatation mat 2 when in the storage and transport position but will change the shape of the hinged floatation mat 2 when deployed.

The hinge coupling 5 will preferably be inserted through either (i) a laterally centered pair of the perimeter holes (e.g., hole 12*b* of the second foam panel 6 and hole 12*b* of the first foam panel 4) so that when the second panel 6 is pivoted to a deployed position which is 180° from the storage and transport position, the hinged floatation mat 2 will have a longer and narrower rectangular shape or (ii) a longitudinally centered pair of the perimeter holes (e.g., hole 12*g* of the second foam panel 6 and hole 12*g* of the first foam panel 4) so that when the second panel 6 is pivoted to a deployed position which is 180° from the storage and transport position, the hinged floatation mat 2 will have a shorter and wider rectangular shape.

The hinge connector 5 can generally be any type of structure, preferably a cylindrical structure, which is effective for pivotably connecting the first and second panels 4 and 6 together and is formed of plastic or other material which is suitable for use in water.

By way of example, but not by way of limitation, hinge connector 5 can be a structure of the type illustrated in FIGS. 4-8 which comprises a first piece 30 and a second piece 32. The first piece 30 comprises (i) a cylindrical tube segment 34 having an inside diameter and an open end 36 and (ii) a radially extending flange or shoulder 38 on the other end of the tube segment 34. The second piece 32 comprises (i) a tube or rod segment 40 having a forward end 42 and an outside diameter which is less than the inside diameter of the cylindrical tube segment 34 of the first piece 30 and (ii) a radially extending flange or shoulder 44 on the rearward end of the tube or rod segment 40. The tube or rod segment 40 of the second piece 32 is receivable or is received in the cylindrical tube segment 34 of the first piece 30 and can be secured therein using a glue or other bonding material, or by forming or using mechanical clips or other clipping or locking elements on or in the first and/or second pieces 30 and 32 of the hinge connector 5.

Some of the perimeter holes provided in the first and second foam panels 4 and 6 can also be positioned such that there will be an alignment of one or more pairs of holes in the first and second panels 4 and 6 whenever the second panel 6 is pivoted to one or more preselected deployed positions with respect to the first panel 4. When the second panel 6 is pivoted to a preselected deployed position and the pair of holes in the second panel 6 and the first panel 4 corresponding to the deployed position are aligned, a locking connector 46 can be removably inserted through the aligned pair of holes to lock the second panel 6 in the deployed position.

For example, in reference to the hinged floatation mat 2 illustrated in FIG. 1-3, when the hinge connector 5 is inserted through the centered perimeter hole 12*b* of the second foam panel 6 and the centered perimeter hole 12*b* of the first foam panel 4 and the second foam panel 6 is pivoted to a deployed position which is 180° from the storage and transport position of the second panel 6, the perimeter hole 12*c* of the second panel 6 will be in alignment with the perimeter hole 12*a* of the first panel 4. This allows the locking connector 46 to be inserted through the perimeter hole 12*c* of the second panel 6 and the perimeter hole 12*a* of the first panel 4 to lock the second panel 6 in the 180° deployed position. The locking connector 46 can then subsequently be removed whenever desired in order to unlock the panels 4 and 6 for pivoting the panel 6 back to the storage and transport position or to a different deployed position.

The locking connector 46 can generally be any type of structure, preferably a cylindrical structure, which (a) is effective for removably locking the second panel 6 in a deployed position, and/or the storage and transport position of the second panel 6, with respect to the first panel 4, (b) is formed of plastic or other material which is suitable for use in water, and (c) will not fall out or otherwise be dislodged during normal use.

Figure 9:
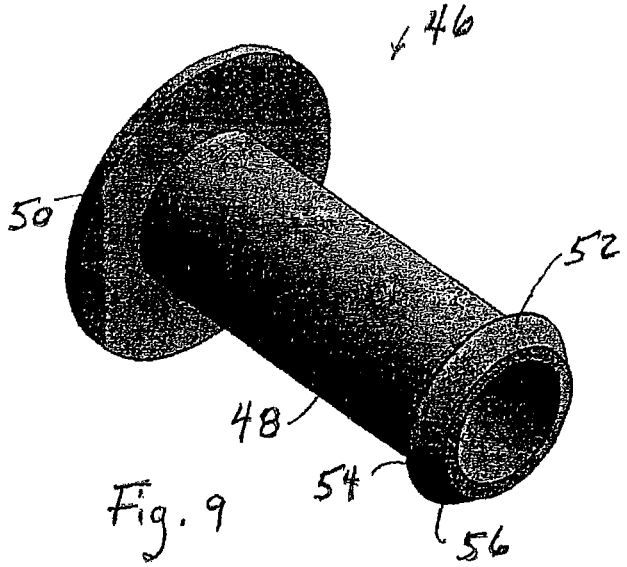
FIG. 9 is a perspective view of a locking connector 46 used in embodiments 2 and 60 of the hinged floatation mat.

By way of example, but not by way of limitation, the locking connector 46 preferably, as shown in FIG. 9, comprises (i) a cylindrical tube segment or other cylindrical segment 48, (ii) a radially extending flange or shoulder 50 on the rearward end of the cylindrical segment 48, and (iii) an anchoring structure 52 on the forward end of the cylindrical segment 48. The anchoring structure 52 comprises a radial shoulder 54 and a short, converging, tapered or conical wall 56 which decreases in diameter as it extends forwardly from the radial shoulder 54. The tapered or conical wall 56 of the anchoring structure 52 assists in inserting the locking connector 46 through the aligned holes of the first and second panels 4 and 6. The diameter of the radial shoulder 54 of the anchoring structure 52 is greater than the diameter of the aligned holes so that, once inserted, the radial shoulder 54 of the locking connector 46 will abut against the bottom surface 57 of the first panel 4 surrounding the hole to prevent the locking connector 46 from falling out of or being dislodged from the aligned holes at least during normal use. However, the radial shoulder 54 is also sufficiently small that the foam material of the panels 4 and 6 will momentarily compress and deflect to a degree adequate to allow the locking connector 46 to be inserted through, and removed from, the panels 4 and 6.

Each foam panel 4 and 6 can optionally also have one or more larger holes 58 which extend through the body of the panel at locations spaced away from the perimeter edges 14, 18, 22, and 24. The hole(s) 58 can be used for gripping, holding cans or cups, or for other purposes. Although any size holes could be used, the holes 58 will preferably have a diameter in the range of from 3 to 3.5 inches.

It will also be understood that rather than inserting the hinge connector 5 through a pair of perimeter holes, e.g., 12*b*-12*b*, of the panels 4 and 6 as described above, the hinge connector 5 can alternatively be inserted through a pair of appropriately sized, correspondingly located, holes which extend through the bodies of the panels 4 and 6 at locations which are spaced away from the perimeter edges 14, 18, 22, and 24.

Figure 10:
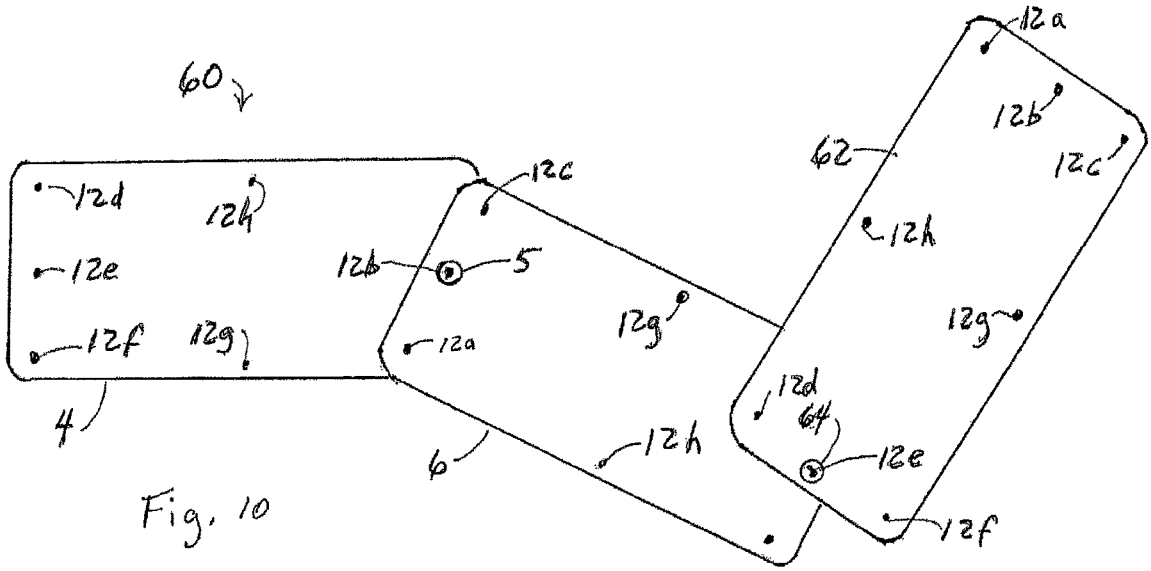
FIG. 10 is a top view of the inventive hinged floatation mat 60 in a partially unfolded position.
Figure 11:
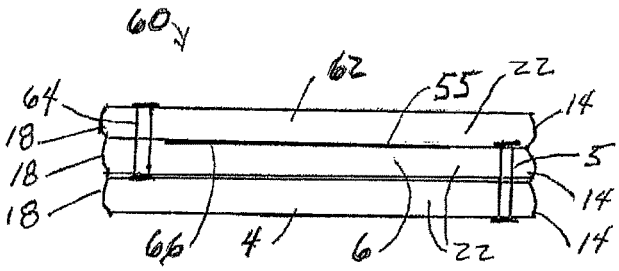
FIG. 11 is an elevational side view of the hinged floatation mat 60 in a folded storage and transport position.

An alternative embodiment 60 of the inventive hinged floatation mat is illustrated in FIGS. 10 and 11. The hinged mat 60 is identical to the hinged mat 2 except that the hinged mat 60 also comprises a third flat foam panel 62 which is pivotably connected to the second flat foam panel 6 by a hinge coupling 64. Although not essential, the third foam panel 62 is preferably identical or substantially identical to the first and second foam panels 4 and 6 and the hinge coupling 64 is preferably identical to the hinge coupling 5.

The third flat foam panel 62 of the inventive hinged floatation mat 60 is pivotable with respect to the second foam panel 6 to a storage and transport position in which the bottom surface 66 of the third panel 62 lies squarely over the top surface 55 of the second panel 6 so that the laterally extending forward edge 14, the laterally extending rearward edge 18, the longitudinally extending right side edge 22, and the longitudinally extending left side edge 24 of the third foam panel 62 are respectively positioned over the corresponding laterally extending forward edge 14, laterally extending rearward edge 18, longitudinally extending right side edge 22, and longitudinally extending left side edge 24 of the second foam panel 6. Consequently, when the second foam panel 6 and the third foam panel 62 are both in their storage and transport positions, the third foam panel 62 will also be positioned squarely over the first foam panel 4.

The hinged floatation mat 60 preferably has an articulated configuration wherein the hinge coupling 64 for the third panel 62 is preferably, although not necessarily, inserted through either (i) a laterally centered pair of perimeter holes, e.g., 12*e*-12*e*, of the third and second panels 62 and 6 which is opposite a laterally centered pair of perimeter holes 12*b*-12*b* of the second and first panels 6 and 4 through which the hinge connector 5 is inserted or (ii) a longitudinally centered pair of perimeter holes, e.g., 12*h*-12*h*, of the third and second panels 62 and 6 which is opposite a longitudinally centered pair of perimeter holes 12*g*-12*g* of the second and first panels 6 and 4 through which the hinge connector 5 is inserted. Each of these two particular articulated connecting arrangements provides a rectangular shape (the second being wider than the first) for the hinged floatation mat 60 when the second foam panel 6 and the third foam panel 62 are each pivoted to deployed positions which are 180° from the respective storage and transport positions of the second and third panels 6 and 62.

As with the second and first foam panels 6 and 4, when the third panel 62 is pivoted to a preselected deployed position with respect to the second panel 6 such that a pair of holes in the third panel 62 and the second panel 6 corresponding to the deployed position are aligned, a second locking connector 46 can be removably inserted through the aligned pair of holes to lock the third panel 62 in the deployed position.

For example, when hinge coupling 5 is inserted through the laterally centered perimeter holes 12*b*-12*b* of the second and first foam panels 6 and 4 and the hinge coupling 64 is inserted through the laterally centered perimeter holes 12*e*-12*e* of the third and second foam panels 62 and 6, the inventive hinged floatation mat 60 can be locked in an elongate rectangular deployed configuration by (a) pivoting the second foam panel 6 180° from its storage and transport position with respect to the first foam panel 4, (b) inserting a first locking connector 46 through the aligned holes 12*c* of the second panel 6 and 12*a* of the first panel 4, (c) pivoting the third foam panel 62 180° from its storage and transport position with respect to the second foam panel 6, and (d) inserting a second locking connector 46 through the aligned holes 12*d* of the third panel 62 and 12*f* of the second panel 6.

It will also be understood that the articulated embodiment of the inventive hinged floatation mat can comprise more than three flat foam panels and that the hinge connectors of all of the articulated embodiments can alternatively be inserted through pairs of appropriately sized, correspondingly located, holes which extend through the bodies of each connected pair of panels at locations spaced away from the perimeter edges 14, 18, 22, and 24.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within the invention as described herein and in the claims.

What is claimed is:

1. A hinged floatation mat comprising:

a first flat foam panel having a length and a width;

a second flat foam panel have a length which does not differ by more than 2 inches from the length of the first flat foam panel and a width which does not differ by more than 2 inches from the width of the first flat foam panel;

a perpendicular hinge connector extending through the first flat foam panel and the second flat foam panel;

the perpendicular hinge connector being perpendicular to the first flat foam panel and the perpendicular hinge connector being perpendicular to the second flat foam panel;

the second flat foam panel being pivotable about the perpendicular hinge connector with respect to the first flat foam panel from (i) a storage position of the second flat foam panel in which the second flat foam panel is parallel to first flat foam panel and a bottom surface of the second flat foam panel lies over a top surface of the first flat foam panel to (ii) one or more deployed positions of the second flat foam panel different from the storage position of the second flat foam panel;

the one or more deployed positions including at least a deployed position in which the second flat foam panel is pivoted about the perpendicular hinge connector 180° with respect to the first flat foam panel from the storage position of the second flat foam panel; and the second flat foam panel remaining in a plane which is parallel to the first flat foam panel, and the perpendicular hinge connector remaining perpendicular to the first and the second flat foam panels, as the second flat foam panel is pivoted about the perpendicular hinge connector with respect to the first flat foam panel from the storage position of the second flat foam panel to each of the one or more deployed positions of the second flat foam panel.

2. The hinged floatation mat of claim 1 further comprising, when the second flat foam panel is in its storage position, (i) the perpendicular hinge connector extending through a hole in the second flat foam panel which is centered along and spaced from 2 to 4 inches from a laterally extending forward edge of the second flat foam panel and (ii) the perpendicular hinge connector extending through a hole in the first flat foam panel which is centered along and spaced from 2 to 4 inches from a laterally extending forward edge of the first flat foam panel.

3. The hinged floatation mat of claim 2 further comprising:

the length of the second flat foam panel does not differ from the length of the first flat foam panel;

the width of the second flat foam panel does not differ from the width of the first flat foam panel; and when the second flat foam panel is in its storage position with respect to the first flat foam panel, the laterally extending forward edge, a laterally extending rearward edge, a longitudinally extending right side edge, and a longitudinally extending left side edge of the second flat foam panel are respectively positioned over the laterally extending forward edge, a laterally extending rearward edge, a longitudinally extending right side edge, and a longitudinally extending left side edge of the first flat foam panel.

4. The hinged floatation mat of claim 1 further comprising:

the length of the first flat foam panel being greater than the width of the first flat foam panel and the length of the second flat foam panel being greater than the width of the second flat foam panel.

5. The hinged floatation mat of claim 4 further comprising, when the second flat foam panel is in its storage position, (i) the perpendicular hinge connector extending through a hole in the second flat foam panel which is centered along and spaced from 2 to 4 inches from a laterally extending forward edge of the second flat foam panel and (ii) the perpendicular hinge connector extending through a hole in the first flat foam panel which is centered along and spaced from 2 to 4 inches from a laterally extending forward edge of the first flat foam panel.

6. The hinged floatation mat of claim 4 further comprising:

the length of the second flat foam panel does not differ from the length of the first flat foam panel;

the width of the second flat foam panel does not differ from the width of the first flat foam panel; and when the second flat foam panel is in its storage position with respect to the first flat foam panel, the laterally extending forward edge, a laterally extending rearward edge, a longitudinally extending right side edge, and a longitudinally extending left side edge of the second flat foam panel are respectively positioned over the laterally extending forward edge, a laterally extending rearward edge, a longitudinally extending right side edge, and a longitudinally extending left side edge of the first flat foam panel.

7. The hinged floatation mat of claim 4 further comprising, when the second flat foam panel is in its storage position, (i) the perpendicular hinge connector extending through a hole in the second flat foam panel which is centered along and spaced from 2 to 4 inches from a longitudinally extending right side edge of the second flat foam panel and (ii) the perpendicular hinge connector extending through a hole in the first flat foam panel which is centered along and spaced from 2 to 4 inches from a longitudinally extending right side edge of the first flat foam panel.

8. The hinged floatation mat of claim 7 further comprising:

the length of the second flat foam panel does not differ from the length of the first flat foam panel;

the width of the second flat foam panel does not differ from the width of the first flat foam panel; and when the second flat foam panel is in its storage position with respect to the first flat foam panel, a laterally extending forward edge, a laterally extending rearward edge, the longitudinally extending right side edge, and a longitudinally extending left side edge of the second flat foam panel are respectively positioned over a laterally extending forward edge, a laterally extending rearward edge, the longitudinally extending right side edge, and a longitudinally extending left side edge of the first flat foam panel.

9. The hinged floatation mat of claim 1 further comprising:

a third flat foam panel have a length which does not differ by more than 2 inches from the length of the first flat foam panel and a width which does not differ by more than 2 inches from the width of the first flat foam panel;

the perpendicular hinge connector being a first perpendicular hinge connector;

a second perpendicular hinge connector, different from the first perpendicular hinge connector, extending through the third flat foam panel and the second flat foam panel;

the second perpendicular hinge connector being perpendicular to the second flat foam panel and the third flat foam panel;

the third flat foam panel being pivotable about the second perpendicular hinge connector with respect to the second flat foam panel from (i) a storage position of the third flat foam panel in which the third flat foam panel is parallel to the second flat foam panel and a bottom surface of the third flat foam panel lies over a top surface of the second flat foam panel to (ii) one or more deployed positions of the third flat foam panel different from the storage position of the third flat foam panel;

the one or more deployed positions of the third flat foam panel including at least a deployed position in which the third flat foam panel is pivoted about the second perpendicular hinge connector 180° with respect to the second flat foam panel from the storage position of the third flat foam panel; and the third flat foam panel remaining in a plane which is parallel to the second flat foam panel, and the second perpendicular hinge connector remaining perpendicular to the second and the third flat foam panels, as the third flat foam panel is pivoted about the second perpendicular hinge connector with respect to the second flat foam panel from the storage position of the third flat foam panel to each of the one or more deployed positions of the third flat foam panel.

10. The hinged floatation mat of claim 9 further comprising, when the second flat foam panel is in the storage position of the second flat foam panel and the third flat foam panel is in the storage position of the third flat foam panel, (i) the second perpendicular hinge connector extending through a hole in the third flat foam panel which is centered along and spaced from 2 to 4 inches from a laterally extending rearward edge of the third flat foam panel;

(ii) the second perpendicular hinge connector extending through a hole in the second flat foam panel which is centered along and spaced from 2 to 4 inches from a laterally extending rearward edge of the second flat foam panel;

(iii) the first perpendicular hinge connector extending through a hole in the second flat foam panel which is centered along and spaced from 2 to 4 inches from a laterally extending forward edge of the second flat foam panel; and (iv) the first perpendicular hinge connector extending through a hole in the first flat foam panel which is centered along and spaced from 2 to 4 inches from a laterally extending forward edge of the first flat foam panel.

11. The hinged floatation mat of claim 10 further comprising:

the length of the second flat foam panel does not differ from the length of the first flat foam panel;

the length of the third flat foam panel does not differ from the length of the first flat foam panel;

the width of the second flat foam panel does not differ from the width of the first flat foam panel;

the width of the third flat foam panel does not differ from the width of the first flat foam panel; and when the second flat foam panel is in the storage position of the second flat foam panel with respect to the first flat foam panel and the third flat foam panel is in the storage position of the third flat foam panel with respect to the second flat foam panel, the laterally extending forward edge, the laterally extending rearward edge, a longitudinally extending right side edge, and a longitudinally extending left side edge of the second flat foam panel are respectively positioned over the laterally extending forward edge, a laterally extending rearward edge, a longitudinally extending right side edge, and a longitudinally extending left side edge of the first flat foam panel and a laterally extending forward edge, the laterally extending rearward edge, a longitudinally extending right side edge, and a longitudinally extending left side edge of the third flat foam panel are respectively positioned over the laterally extending forward edge, the laterally extending rearward edge, the longitudinally extending right side edge, and the longitudinally extending left side edge of the second flat foam panel.

12. The hinged floatation mat of claim 11 further comprising:

the length of the first flat foam panel is greater than the width of the first flat foam panel;

the length of the second flat foam panel is greater than the width of the second flat foam panel; and the length of the third flat foam panel is greater than the width of the third flat foam panel.

13. A hinged floatation mat comprising:

a first flat foam panel having a length and a width;

a second flat foam panel have a length which does not differ by more than 2 inches from the length of the first flat foam panel and a width which does not differ by more than 2 inches from the width of the first flat foam panel;

a hinge connector extending through the first flat foam panel and the second flat foam panel;

the second flat foam panel being pivotable about the hinge connector with respect to the first flat foam panel from (i) a storage position of the second flat foam panel in which a bottom surface of the second flat foam panel lies over a top surface of the first flat foam panel to (ii) one or more deployed positions of the second flat foam panel different from the storage position of the second flat foam panel;

the one or more deployed positions of the second flat foam panel comprising a pivoted position of the second flat foam panel which is 180° from the storage position of the second flat foam panel;

a hole extending through the second flat foam panel which is in alignment with a hole extending through the first flat foam panel when the second flat foam panel is in the pivoted position of the second flat foam panel which is 180° from the storage position of the second flat foam panel; and a locking connector which is removably extendable through the holes extending through the second and first flat foam panels to lock the second flat foam panel in the pivoted position of the second flat foam panel which is 180° from the storage position of the second flat foam panel.

14. A hinged floatation mat comprising:

a first flat foam panel having a length and a width;

a second flat foam panel have a length which does not differ by more than 2 inches from the length of the first flat foam panel and a width which does not differ by more than 2 inches from the width of the first flat foam panel;

a first hinge connector extending through the first flat foam panel and the second flat foam panel;

the second flat foam panel being pivotable about the hinge connector with respect to the first flat foam panel from (i) a storage position of the second flat foam panel in which a bottom surface of the second flat foam panel lies over a top surface of the first flat foam panel to (ii) one or more deployed positions of the second flat foam panel different from the storage position of the second flat foam panel;

a third flat foam panel have a length which does not differ by more than 2 inches from the length of the first flat foam panel and a width which does not differ by more than 2 inches from the width of the first flat foam panel;

a second hinge connector, different from the first hinge connector, extending through the third flat foam panel and the second flat foam panel;

the third flat foam panel being pivotable about the second hinge connector with respect to the second flat foam panel from (i) a storage position of the third flat foam panel in which a bottom surface of the third flat foam panel lies over a top surface of the second flat foam panel to (ii) one or more deployed positions of the third flat foam panel different from the storage position of the third flat foam panel;

the one or more deployed positions of the second flat foam panel comprising a pivoted position of the second flat foam panel which is 180° from the storage position of the second flat foam panel;

a first hole extending through the second flat foam panel which is in alignment with a hole extending through the first flat foam panel when the second flat foam panel is in the pivoted position of the second flat foam panel which is 180° from the storage position of the second flat foam panel;

a first locking connector which is removably extendable through the first hole extending through the second flat foam panel and the hole extending through the first flat foam panel to lock the second flat foam panel in the pivoted position of the second flat foam panel which is 180° from the storage position of the second flat foam panel;

the one or more deployed positions of the third flat foam panel comprising a pivoted position of the third flat foam panel which is 180° from the storage position of the third flat foam panel;

a hole extending through the third flat foam panel which is in alignment with a second hole extending through the second flat foam panel when the third flat foam panel is in the pivoted position of the third flat foam panel which is 180° from the storage position of the third flat foam panel; and a second locking connector which is removably extendable through the hole extending through the third flat foam panel and the second hole extending through the second flat foam panel to lock the third flat foam panel in the pivoted position of the third flat foam panel which is 180° from the storage position of the third flat foam panel.

* * * * *